US005727535A

United States Patent [19]

Wallace

[11] Patent Number: 5,727,535

[45] Date of Patent: Mar. 17, 1998

[54] HEMISPHERICAL PISTON COMBUSTION CHAMBER APPARATUS

[76] Inventor: William K. Wallace, 131042 Kahukai St. Leilani Estates, Pahoa, Hi. 96778

[21] Appl. No.: 707,390

[22] Filed: Sep. 4, 1996

[51] Int. Cl.[6] ..... F02B 59/00; F02B 75/02

[52] U.S. Cl. ..... 123/664; 123/193.6

[58] Field of Search ..... 123/193.4, 193.6, 123/664, 666, 661, 193.5

[56] References Cited

U.S. PATENT DOCUMENTS

| | | | |
|---|---|---|---|
| 1,866,928 | 7/1932 | Gingerich | 123/671 |
| 1,891,326 | 12/1932 | Head | 123/671 |
| 2,046,264 | 6/1936 | Hesselman et al. | 123/276 |
| 2,205,493 | 6/1940 | Saurer | 123/276 |
| 2,749,899 | 6/1956 | Mitchell | 123/666 |
| 3,150,654 | 9/1964 | Robison | 123/279 |
| 3,520,289 | 7/1970 | Hoffman | 123/279 |
| 3,916,864 | 11/1975 | Horstmann | 123/276 |
| 3,999,532 | 12/1976 | Kornhauser | 123/263 |
| 4,182,283 | 1/1980 | Czuba | 123/193.6 |
| 4,375,782 | 3/1983 | Schieber | 123/193.6 |
| 4,651,629 | 3/1987 | Castarede | 123/193.6 |
| 4,745,891 | 5/1988 | Cola | 123/256 |
| 4,771,748 | 9/1988 | Chmela et al. | 123/276 |
| 4,831,917 | 5/1989 | Houben et al. | 123/193.6 |
| 4,932,314 | 6/1990 | Baris | 123/193.6 |
| 5,000,132 | 3/1991 | Takashima | 123/671 |
| 5,136,994 | 8/1992 | Gale | 123/276 |
| 5,170,758 | 12/1992 | Chmela | 123/276 |
| 5,337,714 | 8/1994 | Tracy | 123/279 |

FOREIGN PATENT DOCUMENTS

| | | | |
|---|---|---|---|
| 77821 | 2/1930 | Sweden | 123/671 |

*Primary Examiner*—David A. Okonsky
*Attorney, Agent, or Firm*—Wenderoth, Lind & Ponack

[57] ABSTRACT

In an internal combustion engine, a piston/cylinder arrangement includes a hemispherical combustion chamber formed either in a piston crown secured to a top of the piston or in the piston head itself. This hemispherical combustion chamber occupies substantially an entirety of the surface area of the upper face of the piston crown or piston. A cylinder head extension member extends downwardly into the hemispherical combustion chamber so as to occupy a volume thereof as necessary to increase the compression ratio to a desired value. When the hemispherical combustion chamber is formed in the piston crown, the piston crown is secured to but spaced apart from the piston head so as to insulate the piston crown from the piston head. This enables the piston crown to be formed of superior grade metal relative to the piston head.

38 Claims, 4 Drawing Sheets

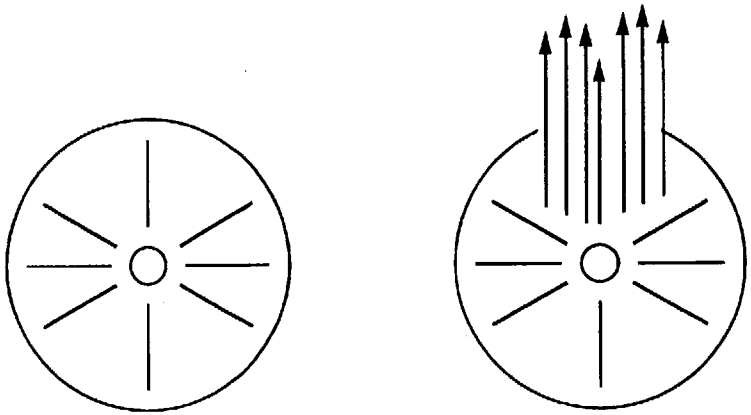
FIG. 10A
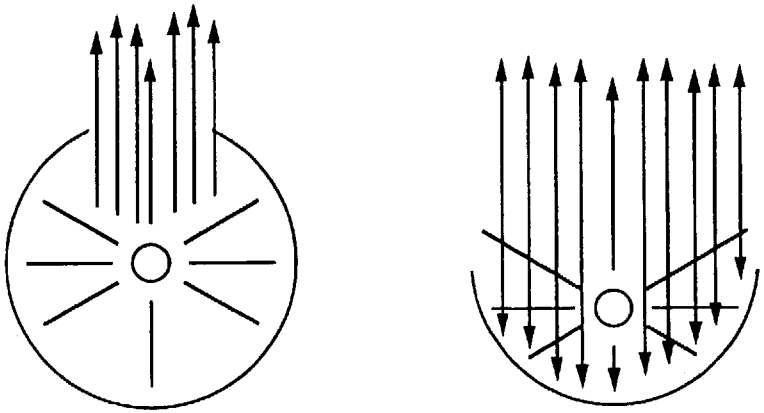
FIG. 10B
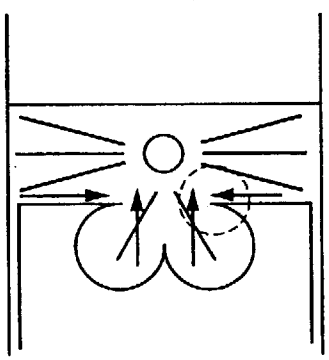
FIG. 10C
FIG. 10D
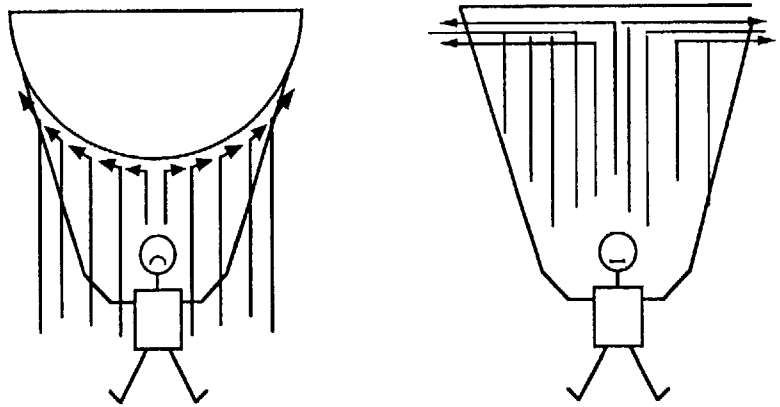
FIG. 10E
FIG. 10F
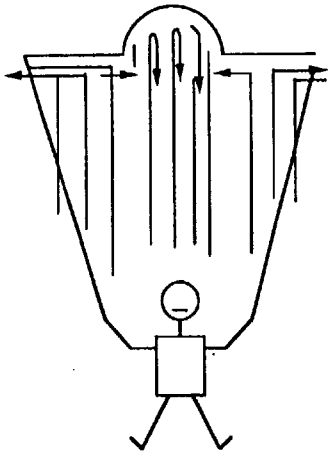
FIG. 10G
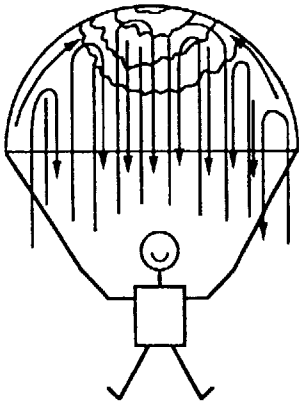
FIG. 10H

HEMISPHERICAL PISTON COMBUSTION CHAMBER APPARATUS

BACKGROUND OF THE INVENTION

The present invention is directed to a combustion chamber apparatus for use in an internal combustion engine and, more particularly, to an apparatus having a hemispherically shaped combustion chamber defined in a piston. The inventive combustion chamber apparatus can be used for internal combustion engines having any number of cylinders.

The common piston/cylinder arrangement in an internal combustion engine is arranged so that a combustion chamber is defined between the cylinder head, a flat piston head, and the cylinder wall. Although this arrangement is quite functional and in wide use today, it has two major disadvantages: (1) this conventional combustion chamber arrangement is extremely inefficient with respect to both the power produced and the fuel expended; and (2) this conventional combustion chamber arrangement results in a relatively high quantity of undesirable exhaust gases which are a major cause of pollution, especially in our metropolitan areas. In fact, this pollution problem has become so severe that many metropolitan areas have been forced to take anti-pollution measures, including the imposition of regulations requiring gasoline additives which reduce carbon monoxide emissions, but which also add to the cost of gasoline and reduce the fuel efficiency in automobiles.

A major culprit in the above-discussed efficiency of today's internal combustion engines is incomplete combustion. The metal surfaces defining the conventional combustion chamber are, either directly or indirectly, liquid or air cooled and are thus considerably cooler than the burning combustion gases. Therefore, as the combustion spreads outwardly from the spark at the spark plug and the wall of flame approaches the cooler metal surfaces, the layers of the fuel-air mixture adjacent these metal surfaces do not burn because they are too cool. That is, the metal surfaces defining a conventional combustion chamber function to remove heat from the fuel-air mixture faster than the wall of flame of the combustion process can add heat thereto and, accordingly, the layers of the fuel-air mixture adjacent the cool metal surfaces do not burn. Along with the combusted gases, this unburnt fuel-air mixture is scavenged from the cylinder by the moving piston during the exhaust stroke. This results in the presence of unburned exhaust gases and carbon monoxide in the automotive exhaust stream.

The prior art is replete with attempts at introducing modified combustion chamber arrangements for internal combustion engines, but each of these attempts is seriously flawed. For example, U.S. Pat. Nos. 4,745,891, 3,916,864, 3,520,289 and 2,046,264 each disclose a combustion chamber arrangement wherein the combustion chamber is defined in the piston. However, each of these combustion chambers is defined with a flat bottom surface so that the force created by the combustion for the purpose of driving the piston is destroyed at a 90 degree angle, and thus, the pressure created by this force is equal to 1×mass×velocity. In addition, this destruction of the force at 90 degree creates an extreme shock against the piston head which effectively limits the upper limit of the compression ratio that can be attained utilizing such arrangement. Reference is made to FIGS. 9A–9C and 10E–10H, wherein FIGS. 9B and 10F illustrate the destruction of force at a 90 degree angle. In particular, in FIGS. 10E–10H, pressure dynamics are illustrated with reference to a descending parachutist. FIGS. 9A and 10E illustrate a force-receiving surface for which very little pressure is generated; FIG. 10E showing a parachute fall through the air with virtually no pressure generating dynamics. In fact, as the velocity of descent increases, the pressure acting on the parachute actually decreases.

FIG. 9B illustrates force dynamics against a flat surface, and FIG. 10F shows a parachute fall through the air in a situation where the force against the parachute is destroyed at a 90 degree angle so that the pressure acting on the parachute equals one×mass×velocity.

FIG. 10G shows a parachute having a design where part of the force receiving surface is flat and part is hemispherical. At the flat portions of the parachute surface, the force is again destroyed at 90 degrees whereas, in the hemispherical portion, the force is destroyed at 180 degrees. FIG. 10G shows how the horizontal force vectors created by the flat surface intersect and conflict with the vertical force vectors created by the hemispherical portion, thereby reducing the effective pressure generated in the contact area. FIG. 9C illustrates force dynamics against a hemispherical surface, and FIG. 10H shows a fully hemispherical parachute for which the force is destroyed at 180 degrees such that the pressure acting upon the parachute is equal to 2×mass×velocity, thereby most effectively slowing the descent by the parachutist by increasing the pressure acting upwardly against the parachute surface. In other words, the effective pressure created by a force is twice as great against a hemispherical surface as against a flat surface.

Various other configurations for piston combustion chambers have been attempted as disclosed, for example, in U.S. Pat. Nos. 5,337,714, 5,136,994, 4,771,748, and 2,205,493. These varied piston combustion chamber configurations, however, are also beset by disadvantages in that the designs make use of only a small portion of the piston head surface area and utilize combustion chamber shapes which result in conflicts between variously directed force vectors.

In this regard, reference is made to FIGS. 10A–10D. FIG. 10A first shows a fully spherical chamber with combustion taking place therein. As illustrated, the forces created by the combustion do not escape the fully enclosed sphere and thus perform no work. FIG. 10B illustrates a spherical chamber such as shown in FIG. 10A but with a small hole formed therein such that the combustion taking place in the spherical chamber performs a small amount of work as illustrated by the force vectors shown in FIG. 10B. FIG. 10D illustrates combustion taking place in a piston/cylinder arrangement wherein the piston has a recess therein of basically the same shape as disclosed in U.S. Pat. No. 2,205,493. As can be seem from FIG. 10D, the open orifice area is considerably less than the diameter of the combustion chamber, such that, as was the case with the spherical chamber of FIG. 10B, most of the combustion force is wasted. In addition, the presence of the flat piston head area together with the concave area results in conflicting force vectors which intersect and thus reduce the overall pressure created by the combustion. FIG. 10C illustrates the dynamics of combustion taking place in a hemispherical chamber. As was discussed above with respect to the dynamics of the parachute shown in FIG. 10H, the combustion which takes place in the hemispherical chamber of FIG. 10C creates force which is destroyed at a 180 degree angle so that the pressure created against the chamber wall in the downward direction is equal 2×mass×velocity.

U.S. Pat. Nos. 3,999,532, 3,150,654 and 2,749,899 show piston/cylinder arrangements utilizing a combustion chamber which is defined in part by a hemispherical recess in the piston head. However, the hemispherical recess in the piston head is formed over only a small portion of the surface area of the piston head and, accordingly, this design is beset by the same disadvantages as present in the illustration of the parachute of FIG. 10G. That is, first, only a small portion of the force created in the combustion chamber acts against the hemispherical surface so as to result in a pressure of 2×mass×velocity; and second, the force destroyed at 90 degrees against the flat portion of the piston head creates force vectors which conflict with the vertical force vectors of the force acting against the hemispherical recess, as illustrated in FIG. 10G, thereby resulting in a reduced effective pressure generated in the contact area. One presumed reason for the use of these relatively small hemispherical recesses in the prior art piston heads is that using larger recesses would considerably reduce the allowable compression ratio and thereby lower the effective power produced by the internal combustion engine.

SUMMARY OF THE INVENTION

It is an object of the present invention to overcome the above-described disadvantages of the prior art.

It is also an object of the present invention to provide a relatively simple apparatus effective to increase power produced by an internal combustion engine, while increasing fuel efficiency and reducing undesirable exhaust gases. The above objects can be attained according to the present invention by providing an apparatus for use in an internal combustion engine, comprising a piston crown having a circular cross-sectional shape, a first axial end and an second axial end; wherein the first axial end is securable to an end of a piston; and wherein the second axial end has a hemispherical combustion chamber formed therein. The hemispherical combustion chamber is formed across substantially an entire face of the second axial end of the piston crown, such that substantially an entirety of the face of the second axial end of the piston crown is concave.

The first axial end of the piston crown preferably has at least one threaded bolt-receiving hole formed therein, for receiving a threaded bolt to secure the piston crown to a piston head. A cylinder head extension member is provided and adapted to be secured to a cylinder head of a cylinder for extending into the hemispherical combustion chamber of the piston crown when the piston crown is mounted in the cylinder. Preferably, the cylinder head extension member is hollow so as to decrease its weight. Also preferably, the cylinder head extension member has a threaded, bolt-receiving hole formed therein for receiving a threaded bolt to secure the cylinder head extension member to the cylinder head. Alternatively, the cylinder head extension member can be otherwise attached to the cylinder head in any suitable manner, including with a bonding adhesive or other fastener member.

The first axial end of the piston crown is spaced apart from the second axial end of the piston, and at least one spacer is interposed between the first axial end of the piston crown and the second axial end of the piston. The at least one spacer can be relatively small with respect to the surface area of the piston head so that a large portion of the space between the piston head and the piston crown is filled with air to act as a thermal insulator. Alternatively, the spacer can be an insulation gasket which fills the entire space between the piston crown and the piston head.

In the preferred form of the invention, the at least one spacer is fixed to one of the first axial end of the piston crown and the second axial end of the piston, and is movable relative to the other of the first axial end of the piston crown and the second axial end of the piston. In this arrangement, said other of the first axial end of the piston crown and the second axial end of the piston preferably has at least one groove formed therein in which at least one spacer is movably received so as to prevent rotation of the piston crown relative to the piston head.

In a preferred form of the cylinder head extension member, the cylinder head extension member has cut-out portions aligned with the valves provided in the cylinder head, so as to allow fluid (e.g. fuel-air mixture and exhaust) to flow to and from the valves. Also in a preferred form of the invention, the cylinder head extension member has an outer shape which is substantially complementary to the shape of the hemispherical combustion chamber.

Although in a preferred formed of the invention the hemispherical combustion chamber is formed in a piston crown which is removably secured to the piston head, it is also contemplated that, in some instances, the hemispherical combustion chamber can be formed in the piston head itself.

BRIEF DESCRIPTION OF THE DRAWINGS

The above and additional objects and features of the present invention will be more fully described hereinbelow with reference to the attached drawings, in which:

FIGS. 10A–10D schematically illustrate force dynamics for combustion in various environments;

FIGS. 10E–10H schematically illustrate force dynamics for variously shaped parachutes.

DETAILED DESCRIPTION OF THE INVENTION

Figure 1:
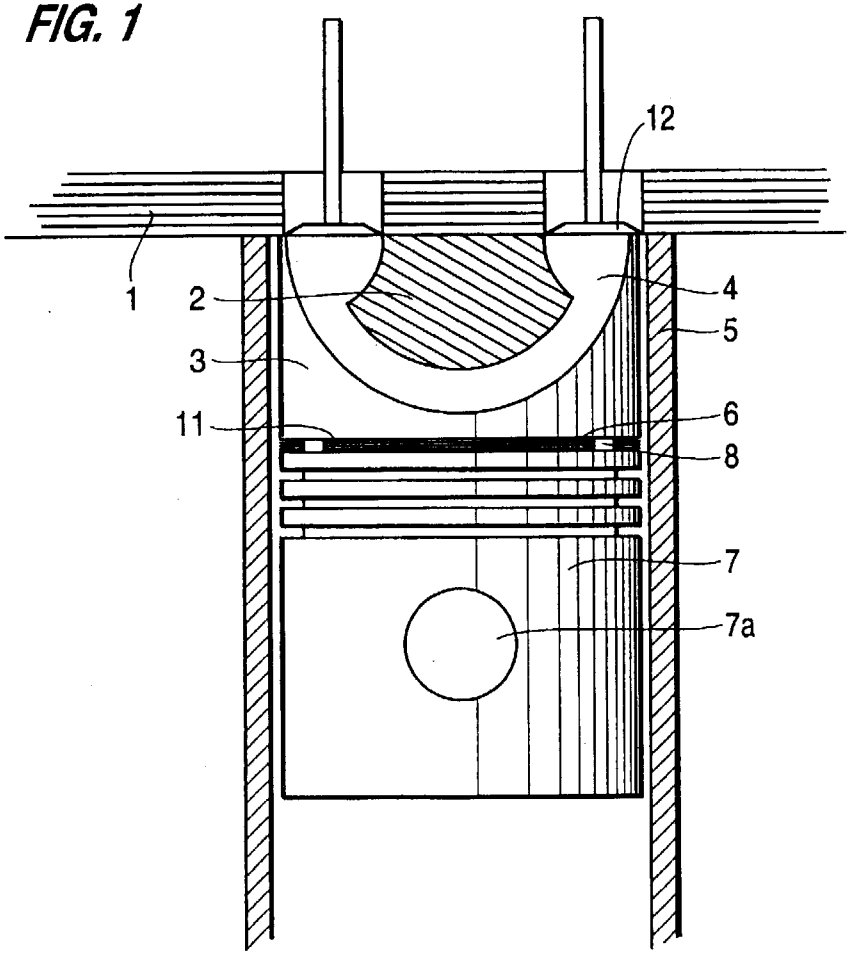
FIG. 1 is a partially cross-sectional view of a piston/cylinder arrangement according to the present invention wherein a piston crown is secured to a piston head.

A piston/cylinder arrangement according to the present invention is illustrated generally in FIG. 1. FIG. 1 illustrates a typical arrangement for a cylinder 5 and cylinder head 1 having valves 12 provided therein. A piston 7 is slidably mounted in the cylinder 5 so as to undergo a combustion cycle which, in a typical four cycle engine, involves an intake stroke, a compression stroke, a power stroke and an exhaust stroke. The piston 7 is connected to a piston rod (not shown) via a pivot connection 7a, as is conventional. According to the present invention, a piston crown 3 is secured to a piston head 10 (FIG. 3) of the piston 7 by threaded bolts 8. The axially bottom end of the piston crown is spaced apart from the axially top end of the piston 7, and an insulation gasket 11 is interposed therebetween. Both the spacing 6 and the insulation gasket 11 serve to thermally insulate the piston crown 3 from the piston 7.

A hemispherical combustion chamber 4 is formed in the upper axial end of the piston crown 3, and this hemispherical combustion chamber 4 is formed over substantially an entire surface area of the upper axial end of the piston crown 3, such that substantially an entirety of the upper face of the piston crown 3 is concave. By "substantially an entire surface area," it is meant that the hemispherical combustion chamber 4 is formed as large as possible given practical constraints such as the characteristics of the material forming the piston crown 3. That is, it will be recognized that the side wall of the piston crown 3 at the top end thereof will have to have a certain minimum dimension to prevent cracking or similar damage thereto during use.

Figure 2:
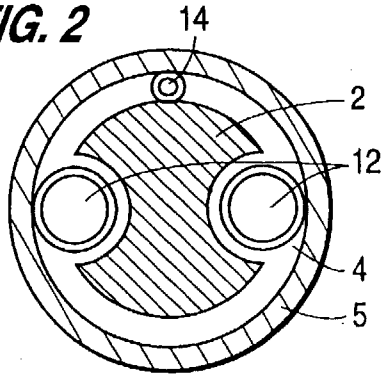
FIG. 2 is a cross-sectional view taken along the line 2—2 of FIG. 6.

According to a preferred form of the invention, a cylinder head extension member 2 is secured to the underside of the cylinder head so as to extend downwardly into the piston combustion chamber 4 and fill a substantial volume thereof. This will allow the compression ratio to be increased, while retaining the characteristic that the hemispherical combustion chamber occupy substantially an entire surface area of the upper axial face of the piston crown 3 so as to greatly improve force dynamics and, in turn, the power output, efficiency and exhaust characteristics of the engine. As can be seen in FIGS. 1 and 2, the cylinder head extension member 2 is preferably formed with a shape generally complementary to the hemispherical combustion chamber, and with cut-outs therein at radial positions corresponding to the positions of valves 12, so as to allow fluid flow (e.g. fluid-air intake and exhaust outflow) to and from valves 12. FIG. 2 also illustrates an exemplary position of the spark-plug 14.

Figure 3:
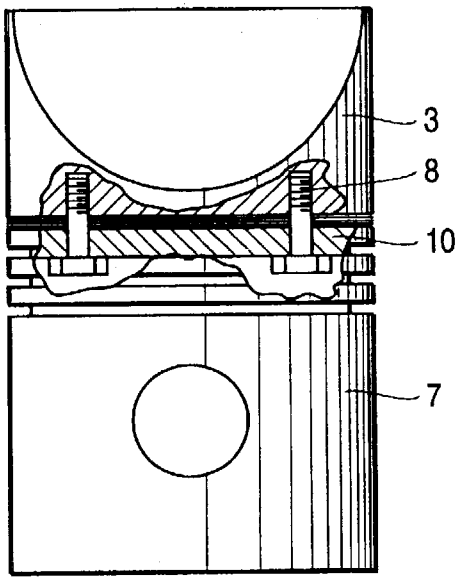
FIG. 3 is a partially cut-away cross-sectional view of the piston and piston crown arrangement shown in FIG. 1.
Figure 4:
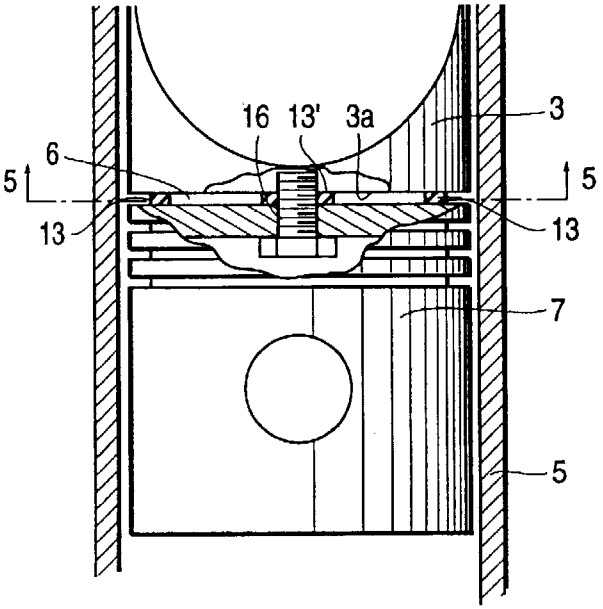
FIG. 4 is a partially cut-away cross-sectional view showing a modified arrangement for securing the piston crown to the piston head according to the present invention.

FIG. 3 illustrates in more detail the securing arrangement for securing the piston crown 3 to the piston head 10 of the piston 7 by way of bolts 8. In this arrangement, two or more bolts are provided, thereby preventing rotation of the piston crown 3 relative to the piston 7. FIG. 4 illustrates a modified form of the securing arrangement for securing the piston crown 3 to the piston 7. In particular, in FIG. 4, the piston crown 3 having a lower piston crown face 3a is secured to the piston head 10 of the piston 7 by only one bolt 16 extending through a through-hole in a piston head 10 and into a threaded, bolt-receiving hole formed in the lower face 3a of the piston crown 3. This arrangement provides the advantage of allowing for differences in thermal expansion of the piston head 10 and the piston crown 3, in the event that the piston head 10 and the piston crown 3 are formed of different materials. That is, because of the separable nature of the piston crown 3 and the piston 7, the two members can be formed of differing materials. For example, the piston crown 3 can be formed of a structurally superior material, such as Silchrome Steel or Stellite, whereas the piston 7 can be formed of a less expensive metal. However, with such differing metals, the piston head 10 and piston crown 3 will tend to expand by different amounts upon the heating created by the internal combustion. This effect may be heightened by the fact that the piston crown 3 is insulated from the piston head 7 by the space 6. The use of only one bolt 16 to secure the piston crown 3 to the piston 7 allows for the different amounts of thermal expansion of the piston crown 3 and piston 7.

Figure 5:
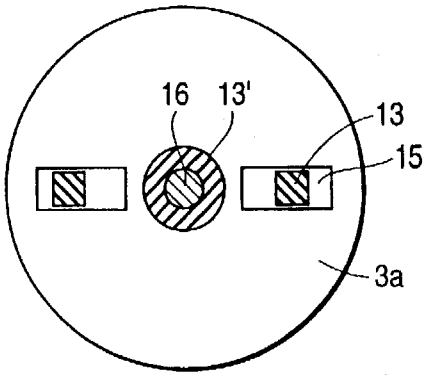
FIG. 5 is a cross-sectional view taken along the line 5—5 of FIG. 4.

In the arrangement shown in FIG. 4, the space 6, rather than being filled by an insulation gasket 11 (FIG. 1), is largely void of structural material. Rather, spacers 13, 13' are provided to maintain the space 6 between the piston head 10 and piston crown 3. As illustrated in FIG. 5, the bottom face of the piston crown 3a can be provided with grooves 15, and the spacers 13 can be slidably mounted therein. More specially, in this arrangement, the spacers 13 are fixed to the upper surface of the piston head 10, but are slidably received in the grooves 15 formed in the bottom face of the piston crown 3. This will accommodate any differences in thermal expansion between the piston head 7 and the piston crown 3, yet will prevent rotation of the piston crown 3 relative to the piston 7. Of course, the grooves 15 can equally well be formed in the upper surface of the piston head 10, with the spacers 13 being fixed to the bottom face 3a of the piston crown 3 and slidably mounted in the grooves 15.

Figure 6:
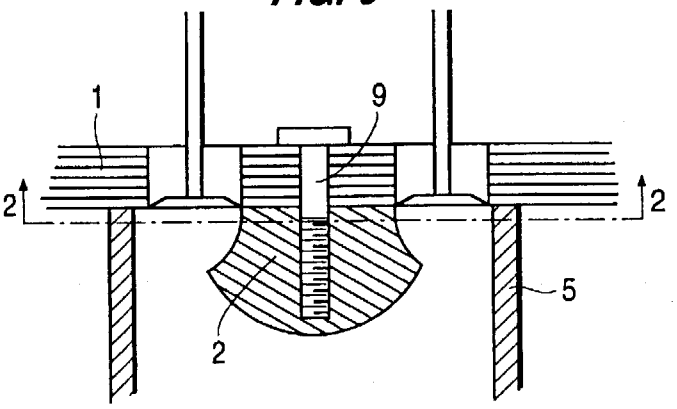
FIG. 6 shows a preferred arrangement for securing a cylinder head extension to a cylinder head according to the present invention.

Although the cylinder head extension member 2 can be secured to the cylinder 1 by any suitable means, including adhesive bonding material or other fasteners, FIG. 6 shows a preferred securing arrangement wherein a threaded bolt 9 is inserted through a through-hole of the cylinder head 1 and into a threaded, bolt-receiving hole 2 formed in the cylinder head extension member 2. It is also contemplated that the cylinder head extension member 2 can be formed integrally with the cylinder head 1.

Figure 8:
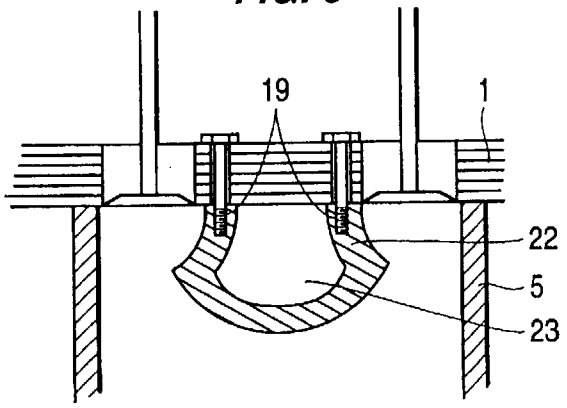
FIG. 8 shows a preferred arrangement for securing the hollow cylinder head extension to the cylinder head.
Figure 7:
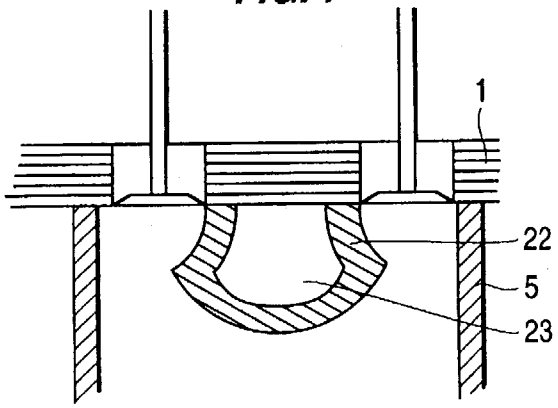
FIG. 7 shows a hollow cylinder head extension according to a preferred form of the present invention.
Figure 9C:
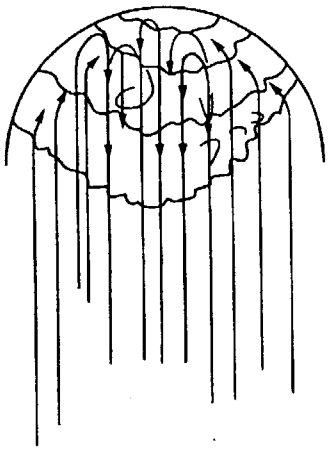
FIGS. 9A, 9B and 9C schematically illustrate force dynamics for a convex hemispherical surface, a flat surface and concave hemispherical surface, respectively.
Figure 9B:
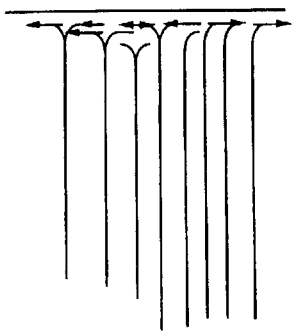
Figure 9A:
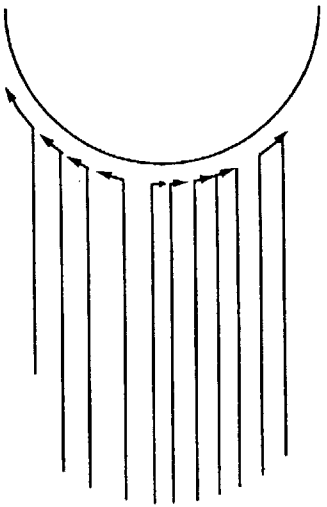

As shown in FIGS. 7 and 8, in the preferred formed of the present invention, the cylinder head extension member 22 is formed with a hollow 23 therein, thereby reducing the overall weight of the arrangement and also reducing heat conduction from the cylinder head extension member 22 to the cylinder head 1. In FIG. 7, it is shown that the cylinder head extension member 22 can be bonded by adhesive to the cylinder head 1 whereas, in FIG. 8, it is shown that the cylinder head extension member 22 can be secured to the cylinder head 1 by threaded bolts 19.

Figure 11:
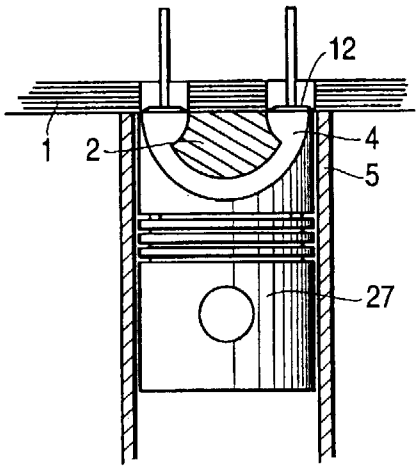
FIG. 11 shows a piston/cylinder arrangement according to the present invention wherein a hemispherical combustion chamber is formed in a piston head.

FIG. 11 illustrates a piston/cylinder arrangement according to the present invention wherein the piston 27 itself is provided with the hemispherical piston combustion chamber 4 formed in an upper surface thereof.

Thus, according to the present invention, superior fuel efficiency can be attained by providing the hemispherical combustion chamber 4 either in a piston crown 3 or in the piston head itself, with the hemispherical combustion chamber occupying substantially an entirety of the upper face of the piston crown 3 or piston head. A significant portion of this advantage is attained because the metal surfaces which define the combustion chamber are much hotter than in the conventional design. That is, the major portion of the combustion chamber walls are defined by the piston crown 3 itself. This piston crown 3 is much less exposed to cooling than the cylinder wall 5.

In addition, the cylinder head extension member 2, 22 defines a large portion of combustion chamber 4, and is itself not directly exposed to the cooler temperatures. This is especially the case with the hollow cylinder head extension member 22. In addition, it is contemplated that insulation, such as a gasket, be provided between the cylinder head extension member 2, 22 and the cylinder head 1.

Thus, the present invention overcomes the problems inherent in the conventional arrangement where layers of the fuel-air mixture adjacent the combustion chamber walls will not burn due to the fact that they are cooled by the combustion walls since the combustion chamber walls conduct heat away from the combustion chamber faster than the heat can be added thereto by the combustion of the fuel-air mixture. Therefore, according to the present invention, virtually all, or at least a much larger proportion of, the fuel-air mixture will be combusted much more fully and with much higher efficiency, thereby resulting in higher fuel efficiency, and fewer undesirable exhaust gases. Further, the insulation of the combustion chamber from the relatively cool metal surfaces also results in speeding up of combustion chamber heat up time during a cold start-up.

Also, the particular shape of the piston crown 3 having the hemispherical combustion chamber 4 causes the power in the power stroke of the piston to be greater due to the greater pressure exerted by the combustion of the fuel-air mixture against the piston crown 3. More specifically, the pressure created against the hemispherical surface of the piston crown 3 will equal 2×mass×velocity; whereas, in the convention design having the flat piston head, the pressure against the piston is equal only one×mass×velocity, due to the effect of the forces being destroyed at a 90 degree angle in the conventional arrangement, versus being destroyed at a 180 degree angle in the present invention.

The provision of the cylinder head extension member 2 allows the compression ratio to be equal to or greater than that of convention internal combustion engines. For example, the present invention can attain compression ratios of 8 to 1 or greater.

Also, the two-part construction of the piston crown 3 and piston 7 enables the piston crown to itself be formed of a superior grade of material, while the piston can be formed of a less expensive metal. This use of a higher grade of material for the piston crown 3 allows for higher combustion forces without damage to the piston crown, yet enables the cost of the apparatus to be maintained relatively low. Although as discussed above the cylinder head extension member can be made integral with the cylinder head 1, it is desirable to make the cylinder head extension member separable from the cylinder head so that it can be removed for resurfacing of the cylinder head and removal of the valves, and also to allow the extension member to be formed hollow to better insulate it against cooling.

A further advantage of the present invention is that the hemispherical shape of the piston crown 3 or piston 27 cushions the shock of the initial combustion against the piston as compared with the initial shock against a flat piston head, in view of the initial shock being spread over a much larger area in the present invention. In other words, the detonation shock is cushioned by the hemispherical shape of the combustion chamber 4. This cushioning of the shock against the piston, together with the ability to form the piston crown of a superior grade metal, enables the piston arrangement to accommodate higher compression ratios which will, in turn, result in increased power.

Although various embodiments of the invention and of various features have been described in detail, the above description should be understand as being only exemplary of the invention. Therefore, it will be understood that various modifications of the construction and operation of the above-described embodiments will be apparent to those of ordinary skill in the art. Accordingly, the scope of the present invention is to be limited only by the appended claims.

What is claimed is:

1. An apparatus for use in an internal combustion engine, said apparatus comprising:

a cylinder having a circular cross-sectional shape;

a piston, having a circular cross-sectional shape, slidably mounted in said cylinder and having a first axial end and a second axial end;

a piston crown having a circular cross-sectional shape, a first axial end and a second axial end and being secured to said piston such that said first axial end of said piston crown confronts said second axial end of said piston, such that said piston crown and said piston are coaxially aligned with one another and such that said piston crown is axially slidably mounted in said cylinder;

a cylinder head fixed in covering relation to an end of said cylinder and confronting said second axial end of said piston crown;

wherein said second axial end of said piston crown has a hemispherical combustion chamber formed therein;

wherein a cylinder head extension member is secured to said cylinder head and extends therefrom toward said piston crown such that said cylinder head extension member projects into said hemispherical combustion chamber of said piston crown when said piston crown is positioned in said cylinder at the end thereof adjacent said cylinder head;

wherein valves are provided in said cylinder head and open into said cylinder; and wherein, in cross section, said cylinder head extension member has a generally circular outer periphery and cut-out portions are formed in said outer periphery, extend radially inwardly from said outer periphery and are aligned with said valves, respectively, for allowing fluid flow to and from said valves.

2. An apparatus as recited in claim 1, wherein said cylinder head extension member is a component separate and discrete from said cylinder head.

3. An apparatus as recited in claim 1, wherein said cylinder head extension member has no through holes therein opening into said cylinder.

4. An apparatus as recited in claim 1, wherein said hemispherical combustion chamber is formed across substantially an entire face of said second axial end of said piston crown, such that substantially an entirety of said face of said second axial end of said piston crown is concave.

5. An apparatus as recited in claim 4, wherein said first axial end of said piston crown is spaced apart from said second axial end of said piston.

6. An apparatus as recited in claim 5, further comprising at least one spacer interposed between said first axial end of said piston crown and said second axial end of said piston.

7. An apparatus as recited in claim 6, wherein said at least one spacer is fixed to one of said first axial end of said piston crown and said second axial end of said piston, and is movable relative to the other of said first axial end of said piston crown and said second axial end of said piston.

8. An apparatus as recited in claim 7, wherein said other of said first axial end of said piston crown and said second axial end of said piston has at least one groove formed therein in which said at least one spacer is movably received.

9. An apparatus as recited in claim 1, wherein said first axial end of said piston crown is spaced apart from said second axial end of said piston.

10. An apparatus as recited in claim 9, further comprising at least one spacer interposed between said first axial end of said piston crown and said second axial end of said piston.

11. An apparatus as recited in claim 10, wherein said at least one spacer is fixed to one of said first axial end of said piston crown and said second axial end of said piston, and is movable relative to the other of said first axial end of said piston crown and said second axial end of said piston.

12. An apparatus as recited in claim 11, wherein said other of said first axial end of said piston crown and said second axial end of said piston has at least one groove formed therein in which said at least one spacer is movably received.

13. An apparatus as recited in claim 1, wherein said cylinder head extension member is hollow.

14. An apparatus as recited in claim 1, wherein said cylinder head extension member has a threaded, bolt-receiving hole formed therein.

15. An apparatus for use in an internal combustion engine, said apparatus comprising:

a cylinder having a circular cross-sectional shape;

a piston member having a circular cross-sectional shape, slidably mounted in said cylinder and having a first axial end and a second axial end, said second axial end of said piston member having a hemispherical combustion chamber formed therein;

a cylinder head fixed in covering relation to an end of said cylinder and confronting said second axial end of said piston member;

a cylinder head extension member secured to said cylinder head and extending therefrom toward said piston member such that said cylinder head extension member projects into said hemispherical combustion chamber of said piston member when said piston member is positioned in said cylinder at the end thereof adjacent said cylinder head;

wherein valves are provided in said cylinder head and open into said cylinder; and wherein, in cross section, said cylinder head extension member has a generally circular outer periphery and cut-out portions are formed in said outer periphery, extend radially inwardly from said outer periphery and are aligned with said valves, respectively, for allowing fluid flow to and from said valves.

16. An apparatus as recited in claim 15, wherein said cylinder head extension member is a component separate and discrete from said cylinder head.

17. An apparatus as recited in claim 15, wherein said cylinder head extension member has no through holes therein opening into said cylinder.

18. An apparatus as recited in claim 15, wherein said hemispherical combustion chamber is formed across substantially an entire face of said second axial end of said piston member, such that substantially an entirety of said face of said second axial end of said piston member is concave.

19. An apparatus as recited in claim 15, wherein said cylinder head extension member is hollow.

20. An apparatus as recited in claim 15, wherein said cylinder head extension member has a threaded, bolt-receiving hole formed therein.

21. An apparatus for use in an internal combustion engine, said apparatus comprising:

a cylinder;

a piston slidably mounted in said cylinder and having a first axial end and a second axial end;

a piston crown having a first axial end and a second axial end and being secured to said piston such that said first axial end of said piston crown confronts said second axial end of said piston, such that said piston crown and said piston are coaxially aligned with one another and such that said piston crown is axially slidably mounted in said cylinder;

a cylinder head fixed in covering relation to an end of said cylinder and confronting said second axial end of said piston crown;

wherein said second axial end of said piston crown has a hemispherical combustion chamber formed therein;

wherein a cylinder head extension member is secured to said cylinder head and extends therefrom toward said piston crown such that said cylinder head extension member projects into said hemispherical combustion chamber of said piston crown when said piston crown is positioned in said cylinder at the end thereof adjacent said cylinder head;

valves provided in said cylinder head, opening into said cylinder and being disposed outwardly of an outer periphery of said cylinder head extension member; and wherein said cylinder head extension member is a component separate and discrete from said cylinder head.

22. An apparatus as recited in claim 21, wherein said cylinder head extension member has no through holes therein opening into said cylinder.

23. An apparatus as recited in claim 21, wherein said hemispherical combustion chamber is formed across substantially an entire face of said second axial end of said piston crown, such that substantially an entirety of said face of said second axial end of said piston crown is concave.

24. An apparatus as recited in claim 23, wherein said first axial end of said piston crown is spaced apart from said second axial end of said piston.

25. An apparatus as recited in claim 24, further comprising at least one spacer interposed between said first axial end of said piston crown and said second axial end of said piston.

26. An apparatus as recited in claim 25, wherein said at least one spacer is fixed to one of said first axial end of said piston crown and said second axial end of said piston, and is movable relative to the other of said first axial end of said piston crown and said second axial end of said piston.

27. An apparatus as recited in claim 24, wherein said other of said first axial end of said piston crown and said second axial end of said piston has at least one groove formed therein in which said at least one spacer is movably received.

28. An apparatus as recited in claim 21, wherein said first axial end of said piston crown is spaced apart from said second axial end of said piston.

29. An apparatus as recited in claim 28, further comprising at least one spacer interposed between said first axial end of said piston crown and said second axial end of said piston.

30. An apparatus as recited in claim 29, wherein said at least one spacer is fixed to one of said first axial end of said piston crown and said second axial end of said piston, and is movable relative to the other of said first axial end of said piston crown and said second axial end of said piston.

31. An apparatus as recited in claim 30, wherein said other of said first axial end of said piston crown and said second axial end of said piston has at least one groove formed therein in which said at least one spacer is movably received.

32. An apparatus as recited in claim 21, wherein said cylinder head extension member is hollow.

33. An apparatus as recited in claim 21, wherein said cylinder head extension member has a threaded, bolt-receiving hole formed therein.

34. An apparatus for use in an internal combustion engine, said apparatus comprising:

a cylinder;

a piston member slidably mounted in said cylinder and having a first axial end and a second axial end, said second axial end of said piston member having a hemispherical combustion chamber formed therein;

a cylinder head fixed in covering relation to an end of said cylinder and confronting said second axial end of said piston member;

a cylinder head extension member secured to said cylinder head and extending therefrom toward said piston member such that said cylinder head extension member projects into said hemispherical combustion chamber of said piston member when said piston member is positioned in said cylinder at the end thereof adjacent said cylinder head;

valves provided in said cylinder head, opening into said cylinder and being disposed outwardly of an outer periphery of said cylinder head extension member; and wherein said cylinder head extension member is a component separate and discrete from said cylinder head.

35. An apparatus as recited in claim 34, wherein said cylinder head extension member has no through holes therein opening into said cylinder.

36. An apparatus as recited in claim 34, wherein said hemispherical combustion chamber is formed across substantially an entire face of said second axial end of said piston member, such that substantially an entirety of said face of said second axial end of said piston member is concave.

37. An apparatus as recited in claim 34, wherein said cylinder head extension member is hollow.

38. An apparatus as recited in claim 34, wherein said cylinder head extension member has a threaded, bolt-receiving hole formed therein.

* * * * *